US006140717A

United States Patent [19]

Fischer et al.

[11] Patent Number: 6,140,717

[45] Date of Patent: Oct. 31, 2000

[54] METHOD AND DEVICE FOR SWITCHING AN INDUCTOR

[75] Inventors: Werner Fischer, Heimsheim; Birte Luebbert, Stuttgart, both of Germany; Viktor Kahr, Milan, Italy; Traugott Degler, Korntal, Germany; Hubert Greif, Markgröningen, Germany; Stephan Jonas, Stuttgart, Germany

[73] Assignee: Robert Bosch GmbH, Stuttgart, Germany

[21] Appl. No.: 09/275,342

[22] Filed: Mar. 24, 1999

[30] Foreign Application Priority Data

Mar. 24, 1998 [DE] Germany ..... 198 12 742

[51] Int. Cl.[7] ..... F02P 5/145

[52] U.S. Cl. ..... 307/125; 307/10.1; 123/604; 361/159

[58] Field of Search ..... 307/10.1, 125; 123/604; 315/209 CD; 361/159, 189

[56] References Cited

U.S. PATENT DOCUMENTS

| | | | |
|---|---|---|---|
| 3,677,255 | 7/1972 | Withem | 123/604 |
| 4,595,975 | 6/1986 | Gray | 363/33 |
| 5,652,504 | 7/1997 | Bangerter | 323/239 |
| 5,717,562 | 2/1998 | Antone et al. | 361/159 |

FOREIGN PATENT DOCUMENTS 37 02 680 10/1987 Germany .

*Primary Examiner*—Albert W. Paladini
*Attorney, Agent, or Firm*—Kenyon & Kenyon

[57] ABSTRACT

A method and device for switching an inductor are described. A first terminal of the inductor may be connected to ground via a first switching device. A second terminal of the inductor is always connected to a voltage power supply. A second inductor may be connected to ground via a second switching device. The energy released in the second inductor when the current flow is interrupted is used to switch the first inductor.

11 Claims, 3 Drawing Sheets

2a
T2
t
Iü
2b
IL2
t
UZ2
2c
UA
t
2d
UB
t
T1
2e
Iü
2f
IL1
Tü
t

METHOD AND DEVICE FOR SWITCHING AN INDUCTOR

FIELD OF THE INVENTION

The present invention relates to a method and a device for switching an inductor.

BACKGROUND INFORMATION

A method and a device for switching an inductor are described in German Patent No. 37 02 680. A coil of a solenoid valve forms an inductor. A rapid switching operation is required with solenoid valves to achieve precision fuel injection. For this purpose, energy released when the inductor is switched off is transferred to a capacitor. In a next switching operation involving the same inductor or in a switching operation involving another inductor, the stored energy causes a rapid current rise.

A disadvantage of this method is that it requires a very large capacitor, which is either very expensive or has only limited suitability for use in motor vehicles because it is neither vibration-resistant nor heat-resistant.

SUMMARY OF THE INVENTION

An object of the present invention is to achieve the fastest possible switching operation with a method and a device for switching an inductor with minimal expense for components. In particular, it is possible to use inexpensive components.

A rapid switching operation can be achieved with the procedure according to the present invention with a reduced cost for circuit elements.

DETAILED DESCRIPTION

A method according to the present invention is described below in the context of a coil of a solenoid valve that is used to control an amount of fuel to be injected for internal combustion engines, in particular diesel engines. In controlling the amount of fuel to be injected, the solenoid valves used must switch very accurately at a certain time in order for the amount of fuel injected to be as accurate as possible and, in the case of diesel engines, for the fuel to be injected as closely as possible at the proper time. This circuit is shown in FIG. 1.

Figure 1:
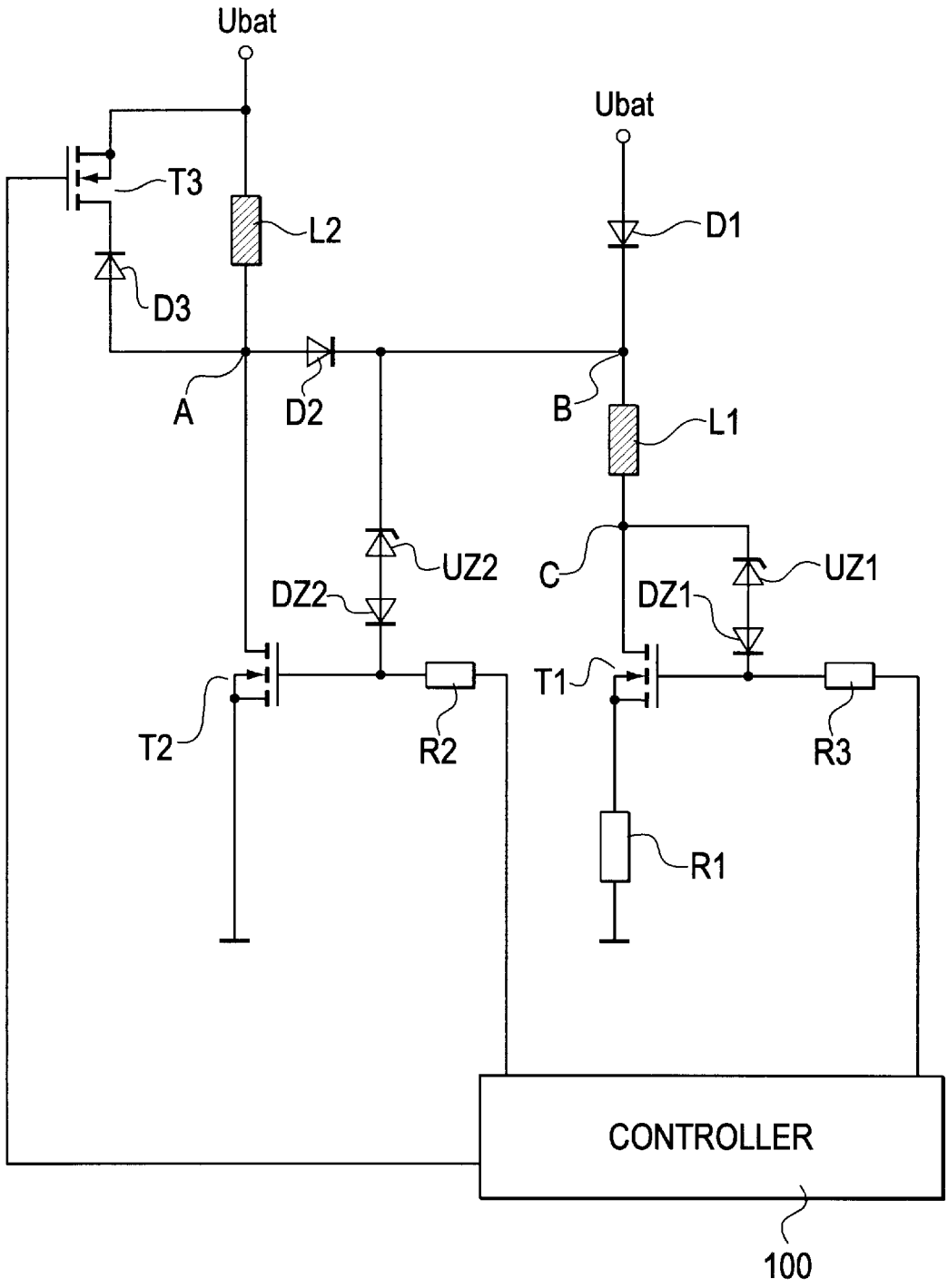
FIG. 1 shows a circuit according to the present invention.

In FIG. 1, the inductor of the solenoid valve to be switched is labeled L1. The first terminal of inductor L1 is connected to ground via a first switching device T1. A resistor R1 may be arranged between first switching device T1 and ground.

A cathode of a first Zener diode UZ1 is connected between tie point C between a first terminal of inductor L1 and first switching device T1. An anode of first Zener diode UZ1 is in contact with an anode of a diode DZ1. The cathode of diode DZ1 is connected to a control terminal of first switching device T1. In addition, the cathode of diode DZ1 and thus also the control terminal of first switching device T1 are connected across a resistor R3 to a controller 100. Zener diode UZ1 and diode DZ1 form a first voltage limiting device.

A second terminal of inductor L1 is connected to voltage power supply UBAT via a tie point B. A diode D1 is preferably arranged at this tie point, with the voltage power supply connected to the anode and inductor L1 connected to the cathode of diode D1.

In addition, another terminal of a second inductor is also connected to voltage power supply UBAT. A first terminal of second inductor L2 is connected to a tie point A. Tie point A is also connected to ground via second switching device T2.

A second terminal of second inductor L2 is connected to the first terminal of second inductor L2 via a third switching device T3 and a diode D3. An anode of diode D3 is in contact with the first terminal. A series connection of third switching device T3 and diode D3 forms a switchable free-wheeling circuit for second inductor L2. Third switching device T3 also receives control signals from controller 100. A free-wheeling circuit is arranged in parallel with each inductor. The free-wheeling circuit of the second inductor is switchable.

Like tie point C, tie point A is connected to a control terminal of second switching device T2 via a second Zener diode UZ2 and a diode DZ2. The control terminal of second switching device T2 is also in contact with controller 100 over a resistor R2. Zener diode UZ2 and diode DZ2 form a second voltage limiting device. A device for limiting the voltage is arranged between the control terminal of the switching device and the respective tie point between the switching device and the inductor.

A second diode D2 is arranged between tie point A and tie point B. The anode of second diode D2 is connected to tie point A, and the cathode of second diode D2 is connected to tie point B. In the embodiment illustrated here, the cathode of second Zener diode UZ2 is connected to the cathode of second diode D2. In an alternative embodiment, the cathode of second Zener diode UZ2 may also be connected to the anode of second diode D2. Tie point A between second inductor L2 and second switching device T2 is connected to tie point B across diode D2 and is thus connected to the second terminal of inductor L1.

First switching device T1, second switching device T2, and third switching device T3 are preferably designed as transistors, in particular as field effect transistors.

A current flowing through inductor L1 may be measured using resistor R1 and optionally regulated using controller 100.

As an alternative, first diode D1 may be designed as a Zener diode. In this case, it is possible to eliminate second voltage limiters UZ2 and DZ2. In addition, it is advantageous if the power loss is not converted to heat in switching device T2 but instead is returned to the voltage supply.

Figure 2:
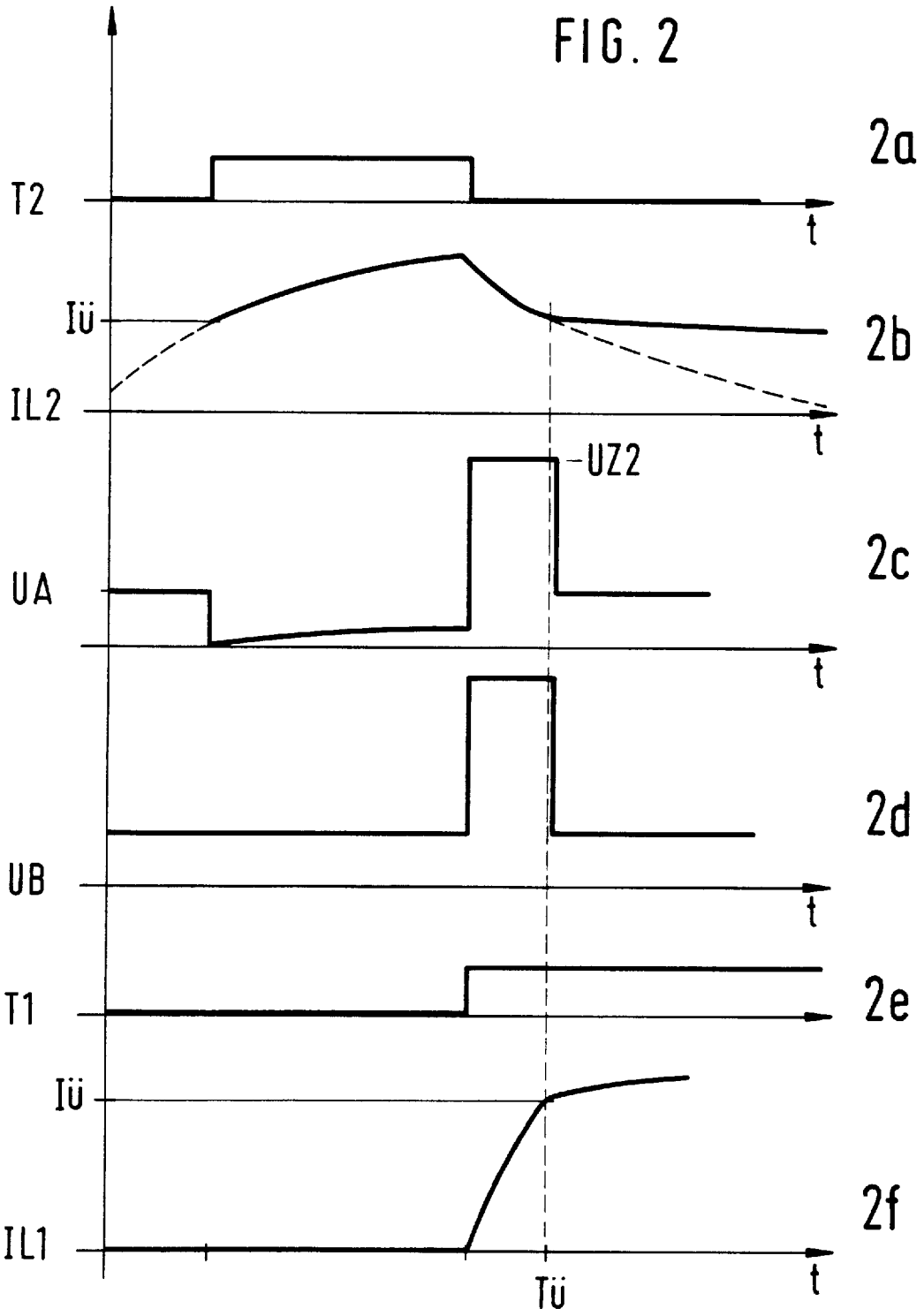
FIG. 2*a* shows a graph of a control signal for a second switching device plotted over time.
FIG. 2*b* shows a graph of current flowing through a second inductor plotted over time.
FIG. 2*c* shows a graph of voltage at a first tie point plotted over time.
FIG. 2*d* shows a graph of a voltage at a second tie point plotted over time.
FIG. 2*e* shows a graph of a control signal for a first switching device plotted over time.
FIG. 2*f* shows a graph of a current flowing through a first inductor plotted over time.

The functioning of this circuit is explained using FIG. 2. In FIG. 2, various signals are plotted over time t. FIG. 2*a* shows a control signal for second switching device T2 plotted over time. FIG. 2*b* shows a plot of current IL2 flowing through second inductor L2 plotted over time. FIG. 2*c* shows voltage UA at tie point A plotted over time. FIG. 2*d* shows voltage UB at tie point B plotted over time. FIG. 2*e* shows the control signal for first switching device T1, and FIG. 2*f* shows current IL1 through first inductor L1 plotted over time.

At time TVOR, second switching device T2 is driven so that it enables a current flow, which causes current IL2 flowing through second inductor L2 to increase. The current flows from voltage power supply UBAT to ground via second inductor L2 and second switching device T2. Energy is stored in inductor L2 in the process. Second inductor L2 is under current in a first phase before the solenoid valve is actually activated. The first phase begins at time TVOR and ends with the actual activation at time TEIN.

Actual activation and thus a second phase begin at time TEIN. Second switching device T2 is activated at time TEIN so that it interrupts the current flow. First switching device T1 is activated so that it enables the current flow. At the end of the first phase with the start of the second phase, the second switching device is opened simultaneously with a closing of first switching device T1.

As a result, voltage UB at tie point B increases from a value corresponding approximately to voltage power supply UBAT to a value corresponding to a Zener voltage of Zener diode UZ2. The second voltage limiting device causes voltage UA at tie point A and voltage UB at tie point B to remain constant at this level. This voltage limiting is necessary in order for the maximum allowed voltage of the switching device not to be exceeded.

A voltage rise is caused by energy stored in the second inductor. This voltage is then available for inductor L1. It is especially advantageous if inductor L2 is much larger than inductor L1. In the second phase between time TEIN and time TÜ, the energy stored in the second inductor is transferred to the first inductor.

Starting at time TEIN, current IL1 flowing through inductor L1 rises very quickly to value IÜ because of voltage UB at tie point B. At the same time, current IL2 flowing through second inductor L2 drops to value IÜ.

At time TÜ, current IL2 and current IL1 assume the same values. At this time, voltage UB at tie point B drops to voltage power supply UBAT. The same thing is true for voltage UA at tie point A. Voltage UA and voltage UB remain at a value corresponding to voltage power supply UBAT until the next time the inductor is activated.

Before time TÜ, switching device T3 is activated so that it enables the current flow. In this way, the energy stored in second inductor L2 may be reduced before switching off inductor L1 and therefore it need not be suppressed in switching off inductor L1.

The second inductor L2 is energized before energizing the actual inductor to achieve a rapid inductor switching operation. Energy is thus loaded into second inductor L2. When the current flow through second inductor L2 is interrupted, a high voltage induced by the energy thus released is used for rapid switching of the first inductor. The current flow is interrupted when first switching device T1 is closed when current flows through inductor L1 at time TEIN, and second switching device T2 is opened ensuring rapid switching of the inductor. Diode D2 guarantees that only the discharge current flows from the second inductor into the first inductor.

Current flow through the inductor is guaranteed only after discharging the second inductor with switching device T1 closed because of the connection to voltage power supply UBAT across diode D1.

In a simplified embodiment, the connection between tie point B and voltage power supply UBAT may be omitted. In this case, current flows constantly through second inductor L2 with switching device T1 closed.

In the embodiment shown in FIG. 1, it is advantageous that current is flowing only through inductor L1 when second inductor L2 is discharged. Inductor L2 need not receive current any longer. Therefore, shutdown operation may be accelerated in opening switching device T1, because only a relatively small inductance need be suppressed. This is the case in particular when inductor L2 is already discharged by the switchable free-wheeling circuit that contains diode D3 and the third switching device.

In an especially advantageous embodiment, the second inductor is a solenoid valve which serves to control fuel injection, in particular the start of fuel injection.

Such solenoid valves are also used, for example, with distributor pump systems. Certain systems, which are also known as solenoid valve-controlled distributor pumps, have two solenoid valves for determining an injection volume and an injection time. The first solenoid valve, also known as a flow rate solenoid valve, assumes a function of high pressure control and thus determines the amount of fuel injected. The second solenoid valve, also known as an injection adjuster solenoid valve, regulates the injection time through a hydraulic system. The full flexibility required by engine conditions is achieved with the two solenoid valves.

By activating the flow rate solenoid valve twice, the injection volume is metered in two phases. Before the actual injection, there is a preinjection, which greatly reduces the noise generated in diesel engines.

Representation of the preinjection with the flow rate solenoid valve requires short switch-on times and switch-off times for the flow rate solenoid valve.

The present invention provides that the injection adjuster solenoid valve may be used as second inductor L2. Its energy released in disconnection is used for accelerated switching-on of the flow rate solenoid valve.

A magnetic circuit and the coil of the injection adjuster solenoid valve is designed so that a sufficient amount of energy is made available.

Figure 3:
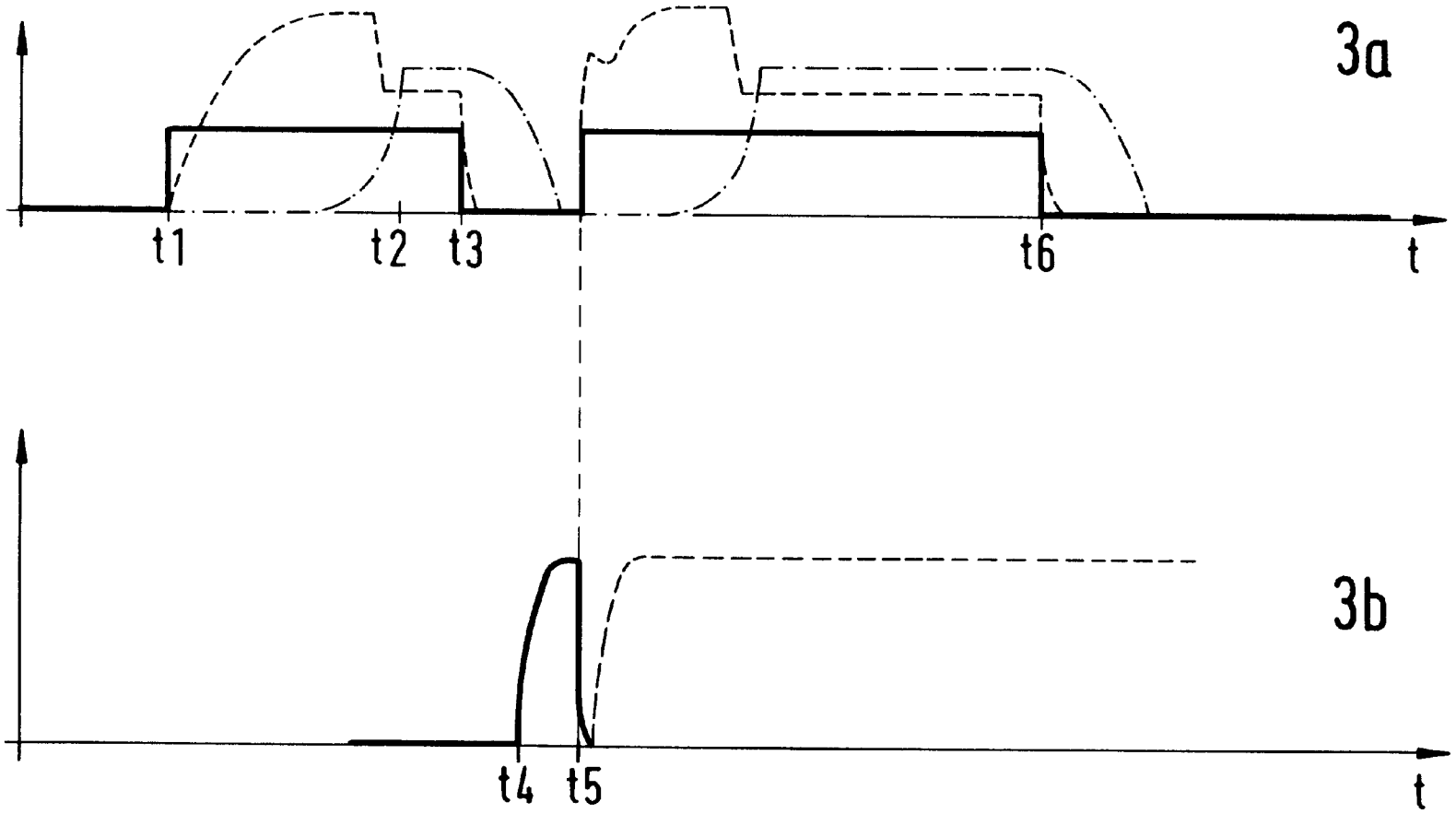
FIG. 3*a* shows a graph of a control signal for a flow rate solenoid, current flowing through the flow rate solenoid, and a stroke of a valve needle of the flow rate solenoid plotted over time.
FIG. 3*b* shows a graph of the control signal and the current shown in FIG. 3*a* for a certain time interval.

FIGS. 3*a* and 3*b* show the control signal for the flow rate solenoid valve with a solid line, the current flowing through the flow rate solenoid valve with a dotted line, and the stroke of the valve needle of the flow rate solenoid valve with a dash-dot line plotted over time for injection with preinjection and main injection.

At time t1, the control of the flow rate solenoid valve begins; this means that switching device T1 goes into its closed state. As a result, the current rises. After a lag time, the stroke of the solenoid valve needle increases. At time t2, the solenoid valve needle reaches its new end position. At time t3 the control of the preinjection ends. This means that switching device T1 goes into its nonconducting position, the current drops, and the solenoid valve needle returns to its starting position.

At time t4, which corresponds to time TVOR in FIG. 2, an injection adjuster magnet receives current, which means that switching device T2 goes into its conducting state. As a result, the current flowing through the injection adjuster rises to its maximum level at which the coil reaches saturation and the maximum possible energy is taken up.

At time t5, corresponding to time TEIN in FIG. 2, control of switching device T2 is canceled and the current flow through the injection adjuster magnet is interrupted. The control of the flow rate solenoid valve begins at the same time, which means that switching means T1 goes into its closed state. As a result, the current rises. After a lag time, the stroke of the solenoid valve needle increases, reaching its new end position at a later time. Control for the main injection ends at time t6. This means that switching device T1 goes into its nonconducting position, the current drops and the solenoid valve needle returns to its starting position.

It is especially important that the interval of time between preinjection and main injection is as short as possible. Transfer of magnetic energy is provided for this reason. Magnetic energy is transferred at time TEIN, when the control of the flow rate solenoid valve for the main injection begins.

In order to allow energy conversion to take place at each operating point, control is achieved in such a way that the injection adjuster solenoid valve receives current at time TEIN. This means that, depending on a pulse duty factor selected, which corresponds to a percentage control of the injection adjuster solenoid valve at a fixed frequency, the injection distributor solenoid valve is controlled in such a way that it reaches saturation by time TEIN.

At this time TEIN, the injection adjuster solenoid valve must be carrying current. Approximately 0.4 msec is required to drive the magnetic circuit of the injection adjuster solenoid valve to saturation. Approximately 0.1 msec after the transfer of the magnetic energy, the injection adjuster solenoid valve may again be controlled according to the requirements for the injection time. The total time required for the transfer is only 0.5 msec. This means that the injection adjuster magnet may be controlled according to the requirements for the start of injection at time t7. This is shown with a dashed line.

An injection cycle at a speed of 1800 rpm and a 6-cylinder pump takes approximately 5.5 msec; in other words, approximately 10% of this time is needed for the energy transfer. Thus, there are no restrictions for the variability of the pulse duty factor of the injection adjuster solenoid valve.

It is especially advantageous that no other components such as a high-voltage capacitor or coil are needed, there are short electric paths with low electric losses accordingly from the injection adjuster solenoid valve to the flow rate solenoid valve, because both are controlled by one controller which is located in the immediate vicinity of the two solenoid valves. No other electric connections are needed. The full flexibility of the injection adjuster solenoid valves is maintained, and no additional space is required in the controller.

What is claimed is:

1. A method of switching a first inductor, a first terminal of the first inductor being connectable to ground via a first switch, a second terminal of the first inductor being coupled to a power supply voltage, comprising the steps of:

interrupting a flow of current through a second inductor, the second inductor being connectable to the ground via a second switch;

controlling the second switch so that energy stored in the second inductor is released when the flow of current is interrupted; and switching the first inductor by directly using the released energy.

2. The method according to claim 1, further comprising the steps of:

receiving the current in the second inductor during a first phase;

transferring the energy stored in the second inductor to the first inductor in a subsequent second phase; and receiving the current only in the first inductor during a third phase.

3. The method according to claim 1, further comprising the step of:

opening the second switch at an end of a first phase while closing the first switch.

4. The method according to claim 3, further comprising the step of:

rapidly switching the first inductor using the energy released by opening the second switching device.

5. A device for switching a first inductor, comprising:

a first switch, a first terminal of the first inductor being connectable to ground via the first switch, a second terminal of the first inductor being coupled to a power supply voltage;

a second switch;

a second inductor being connectable to the ground via the second switch and being coupled to the power supply voltage; and an arrangement controlling the first switch and the second switch, the arrangement directly using energy released from the second inductor to switch the first inductor, the energy being released when a flow of current through the second inductor is interrupted.

6. The device according to claim 5, wherein a tie point between the second inductor and the second switch is connected to the second terminal of the first inductor.

7. The device according to claim 6, further comprising:

a diode, the tie point being coupled to the second terminal of the first inductor via the diode.

8. The device according to claim 5, further comprising:

a first voltage limiting device arranged between a control terminal of the first switch and a tie point between the first switch and the first inductor; and a second voltage limiting device arranged between a control terminal of the second switch and a tie point between the second switch and the second inductor.

9. The device according to claim 5, further comprising:

a switchable free-wheeling circuit arranged in parallel with the second inductor.

10. The device according to claim 5, wherein the second terminal of the first inductor is coupled to the power supply voltage via a zener diode.

11. The device according to claim 5, wherein the second inductor includes a solenoid valve controlling a start of a fuel injection.

* * * * *